US010591163B2

(12) United States Patent
Porter et al.

(10) Patent No.: US 10,591,163 B2
(45) Date of Patent: Mar. 17, 2020

(54) SWIRLER FOR COMBUSTOR OF GAS TURBINE ENGINE

(71) Applicant: United Technologies Corporation, Farmington, CT (US)

(72) Inventors: Steven D. Porter, Wethersfield, CT (US); Cara M. Redding, Chicopee, MA (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 291 days.

(21) Appl. No.: 15/656,742

(22) Filed: Jul. 21, 2017

(65) Prior Publication Data

US 2019/0024896 A1 Jan. 24, 2019

(51) Int. Cl.

| | |
|---|---|
| ***F23R 3/14*** | (2006.01) |
| ***F23R 3/28*** | (2006.01) |
| ***F23C 7/00*** | (2006.01) |

(52) U.S. Cl.

CPC ..... *F23R 3/14* (2013.01); *F23C 7/004* (2013.01); *F23R 3/28* (2013.01); *F23R 3/286* (2013.01); *F23D 2206/10* (2013.01)

(58) Field of Classification Search

CPC .... F23R 3/28; F23R 3/286; F23R 3/14; F23R 3/32; F23R 3/24

See application file for complete search history.

(56) References Cited

U.S. PATENT DOCUMENTS

| | | | | |
|---|---|---|---|---|
| 4,218,020 | A * | 8/1980 | Reider | F23R 3/14 239/406 |
| 6,119,459 | A * | 9/2000 | Gomez | F23C 7/004 60/748 |
| 9,371,990 | B2 | 6/2016 | Moran et al. | |
| 9,376,985 | B2 | 6/2016 | Burd | |
| 9,404,656 | B2 | 8/2016 | Burd | |
| 2014/0165585 | A1* | 6/2014 | Burd | F23R 3/14 60/776 |
| 2016/0209040 | A1* | 7/2016 | Tamura | F23R 3/32 |
| 2018/0335214 | A1* | 11/2018 | Strickland | F23R 3/14 |

FOREIGN PATENT DOCUMENTS

| | | |
|---|---|---|
| EP | 2743587 A2 | 6/2014 |
| WO | 2014099158 A1 | 6/2014 |

OTHER PUBLICATIONS

European Search Report Issued in EP Application No. 18185063.7, dated Oct. 31, 2018, 8 pages.

* cited by examiner

*Primary Examiner* — Craig Kim
(74) *Attorney, Agent, or Firm* — Cantor Colburn LLP

(57) ABSTRACT

A combustor for a gas turbine engine includes an annular combustor shell, the annular combustor shell defining a combustion chamber, and a fuel injector extending at least partially into the combustion chamber, and configured to deliver a flow of fuel and a flow of combustion air into the combustion chamber for combustion. The fuel injector includes a swirler with a swirler exit having a circumferential width along a circumferential axis greater than a radial width along a radial axis. A swirler for a gas turbine engine includes a swirler entrance and a swirler exit. The swirler exit has a circumferential width along a curvilinear circumferential axis greater than a radial width along a radial axis.

15 Claims, 4 Drawing Sheets

SWIRLER FOR COMBUSTOR OF GAS TURBINE ENGINE

BACKGROUND

Exemplary embodiments pertain to the art of gas turbine engines. More particularly, the present disclosure relates to a swirler for a combustor of a gas turbine engine.

A gas turbine engine typically includes a combustor to ignite and combust an air-fuel mixture producing exhaust, which drives a turbine. The combustor typically has a shell and a liner with an air passage defined therebetween. In an annular combustor, an outer liner and an inner liner cooperate to define an annular combustion chamber between the inner liner and the outer liner. A plurality of fuel injectors with associated swirlers are typically positioned in the annular combustion chamber. The fuel injectors release fuel into the combustion chamber, while the swirlers create turbulence in the combustion chamber and mix the combustion air and fuel before the mixture is combusted.

A typical swirler has a circular outlet resulting in a conical spray of the fuel and air mixture. This conical spray and the resultant conical flame pattern often does not align well with the axially long and annular shape of the combustion chamber, thus resulting in areas of "touchdown" or contact of the flame pattern on the inner and/or outer liner of the combustor. Such touchdown has the potential to shorten the useful service life of the combustor and the turbine.

BRIEF DESCRIPTION

In one embodiment, a combustor for a gas turbine engine includes an annular combustor shell, the annular combustor shell defining a combustion chamber, and a fuel injector extending at least partially into the combustion chamber, and configured to deliver a flow of fuel and a flow of combustion air into the combustion chamber for combustion. The fuel injector includes a swirler with a swirler exit having a circumferential width along a circumferential axis greater than a radial width along a radial axis.

Additionally or alternatively, in this or other embodiments the circumferential axis is coaxial with the annular combustor shell.

Additionally or alternatively, in this or other embodiments the circumferential width is between 1.5 times the radial width and 3 times the radial width.

Additionally or alternatively, in this or other embodiments the swirler exit includes an inboard exit portion formed with an inboard radius, and an outboard exit portion formed with an outboard radius. One or more of the inboard radius and the outboard radius are coaxial with the annular combustor shell.

Additionally or alternatively, in this or other embodiments the annular combustor shell includes an outer shell, an inner shell located radially inboard of the outer shell, and a combustor bulkhead extending between the inner shell and the outer shell. The fuel injector extends at least partially through the combustor bulkhead into the combustion chamber.

Additionally or alternatively, in this or other embodiments the fuel injector includes a fuel nozzle, with the swirler located radially outboard of the fuel nozzle.

Additionally or alternatively, in this or other embodiments the swirler includes a plurality of swirler vanes positioned between a swirler entrance and the swirler exit.

In another embodiment, a gas turbine engine includes a turbine section and a combustor section to provide combustion gases to the turbine section to drive the turbine section. The combustion section includes an annular combustor shell, the annular combustor shell defining a combustion chamber, and a fuel injector extending at least partially into the combustion chamber, and configured to deliver a flow of fuel and a flow of combustion air into the combustion chamber for combustion. The fuel injector includes a swirler with a swirler exit having a circumferential width along a circumferential axis greater than a radial width along a radial axis.

Additionally or alternatively, in this or other embodiments the circumferential axis is coaxial with the annular combustor shell.

Additionally or alternatively, in this or other embodiments the circumferential width is between 1.5 times the radial width and 3 times the radial width.

Additionally or alternatively, in this or other embodiments the swirler exit includes an inboard exit portion formed with an inboard radius and an outboard exit portion formed with an outboard radius. One or more of the inboard radius and the outboard radius are coaxial with the annular combustor shell.

Additionally or alternatively, in this or other embodiments the annular combustor shell includes an outer shell, an inner shell located radially inboard of the outer shell, and a combustor bulkhead extending between the inner shell and the outer shell. The fuel injector extends at least partially through the combustor bulkhead into the combustion chamber.

Additionally or alternatively, in this or other embodiments the fuel injector includes a fuel nozzle, with the swirler located radially outboard of the fuel nozzle.

Additionally or alternatively, in this or other embodiments the swirler includes a plurality of swirler vanes located between a swirler entrance and the swirler exit.

In yet another embodiment, a swirler for a gas turbine engine includes a swirler entrance and a swirler exit. The swirler exit has a circumferential width along a curvilinear circumferential axis greater than a radial width along a radial axis.

Additionally or alternatively, in this or other embodiments the circumferential width is between 1.5 times the radial width and 3 times the radial width.

Additionally or alternatively, in this or other embodiments the swirler exit includes an inboard exit portion formed with an inboard radius and an outboard exit portion formed with an outboard radius. One or more of the inboard radius and the outboard radius are coaxial with the curvilinear circumferential axis.

Additionally or alternatively, in this or other embodiments a circumferential end portion connects the inboard exit portion and the outboard exit portion.

Additionally or alternatively, in this or other embodiments the circumferential end portion is curvilinear.

Additionally or alternatively, in this or other embodiments a plurality of swirler vanes are located between the swirler entrance and the swirler exit.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
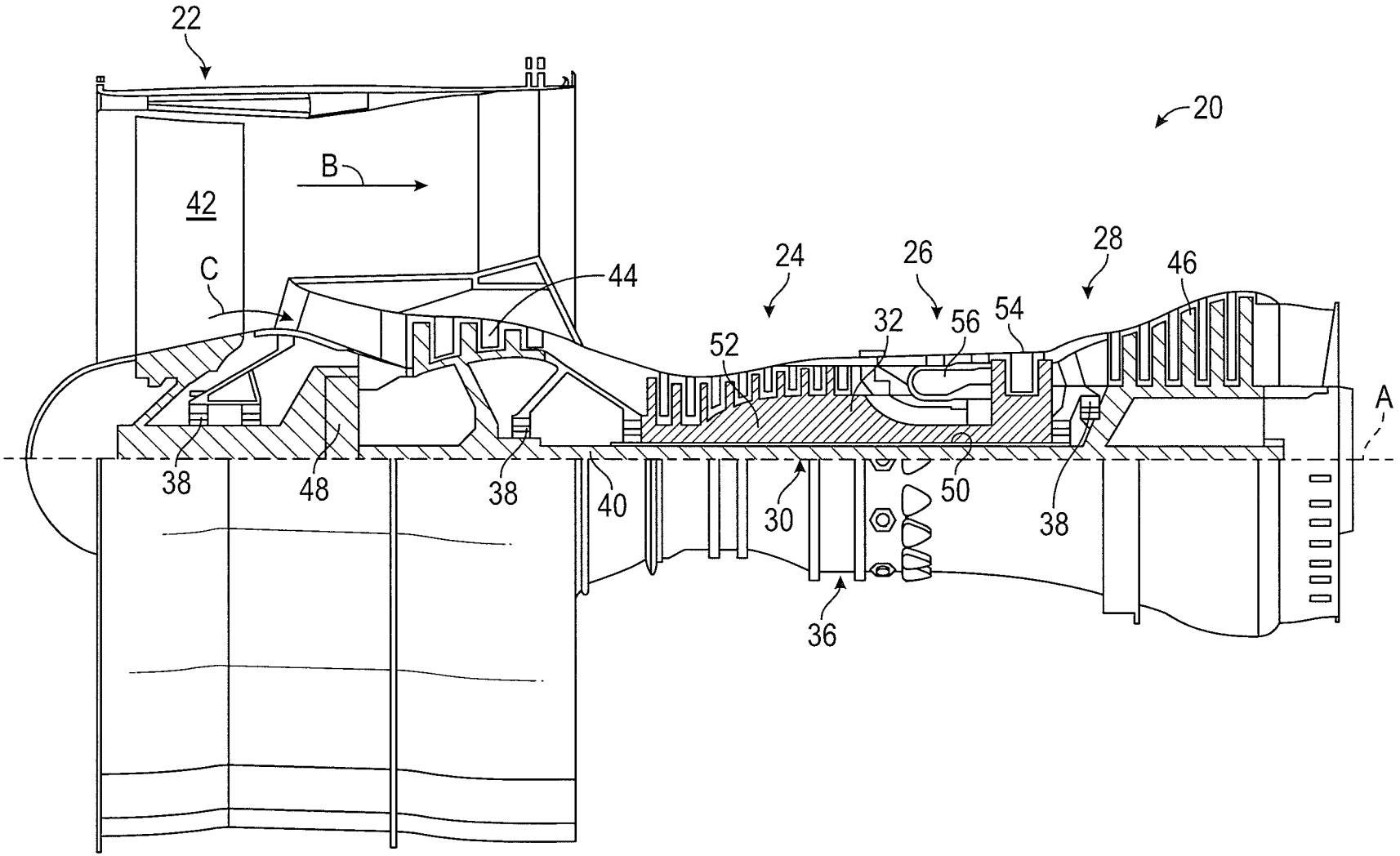
FIG. 1 is schematic cross-sectional view of an embodiment of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. An engine static structure 36 is arranged generally between the high pressure turbine 54 and the low pressure turbine 46. The engine static structure 36 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present disclosure is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,688 meters). The flight condition of 0.8 Mach and 35,000 ft (10,688 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150 ft/second (350.5 m/sec).

Figure 2:
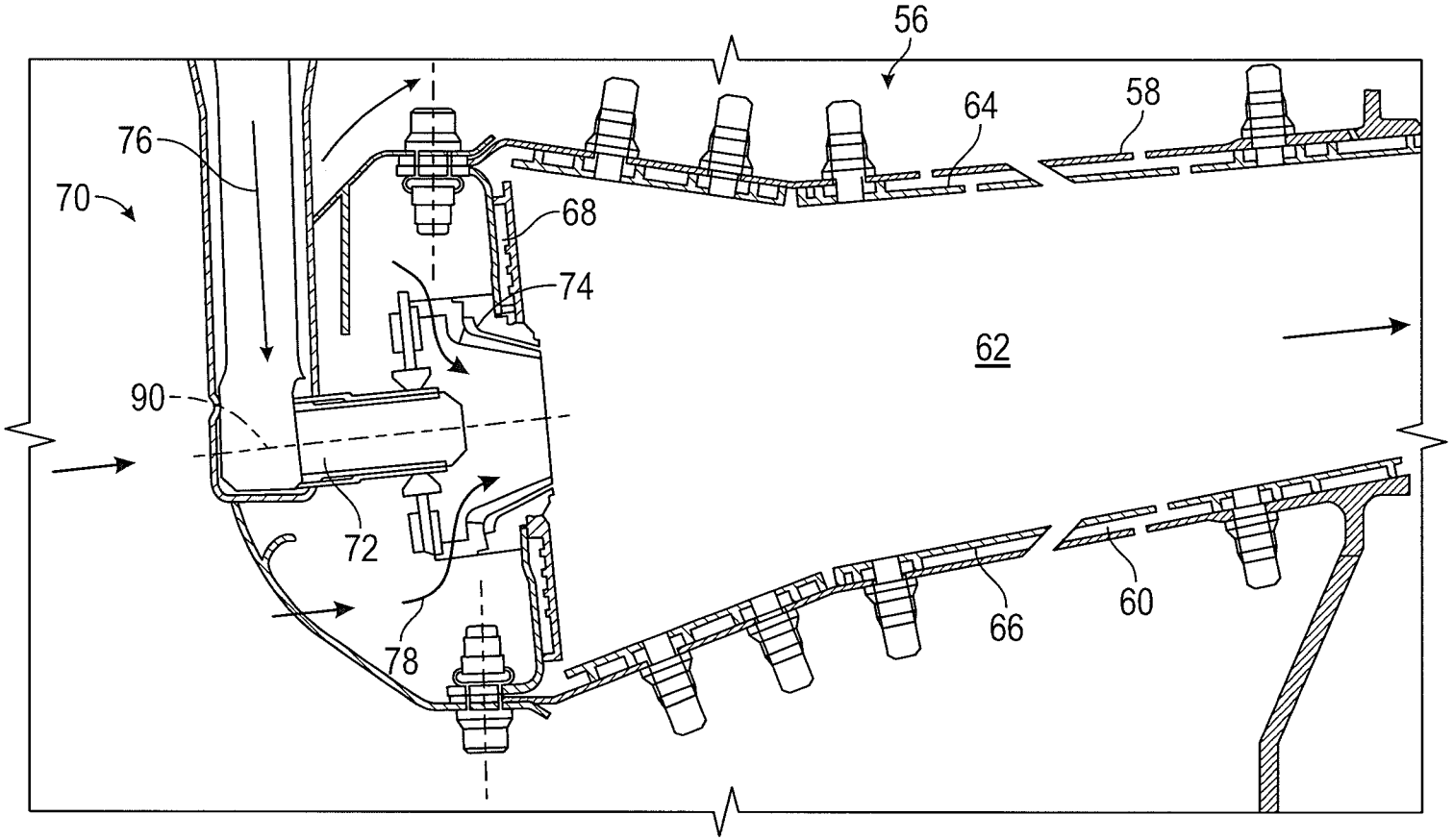
FIG. 2 is a schematic cross-sectional view of an embodiment of a combustor of a gas turbine engine.

Referring now to FIG. 2, a cross-sectional view of an embodiment of a combustor 56 is shown. The combustor 56 may be annular, and is positioned about the engine central longitudinal axis A. The combustor 56 has an outer shell 58 and an inner shell 60, which cooperate to define a combustion chamber 62 therebetween. In some embodiments, an outer liner 64 is positioned radially inwardly from the outer shell 58 and an inner liner 66 is positioned radially outwardly from the inner shell 60. The liners 64 and 66 may act as a thermal barrier to protect the shells 58 and 60, respectively, from high temperatures in the combustion chamber 62. A combustor bulkhead 68 extends between the outer shell 58 and the inner shell 60 to define an axially-upstream extent of the combustion chamber 62. In some embodiments, the combustor bulkhead 68 is annular in shape.

Figure 3:
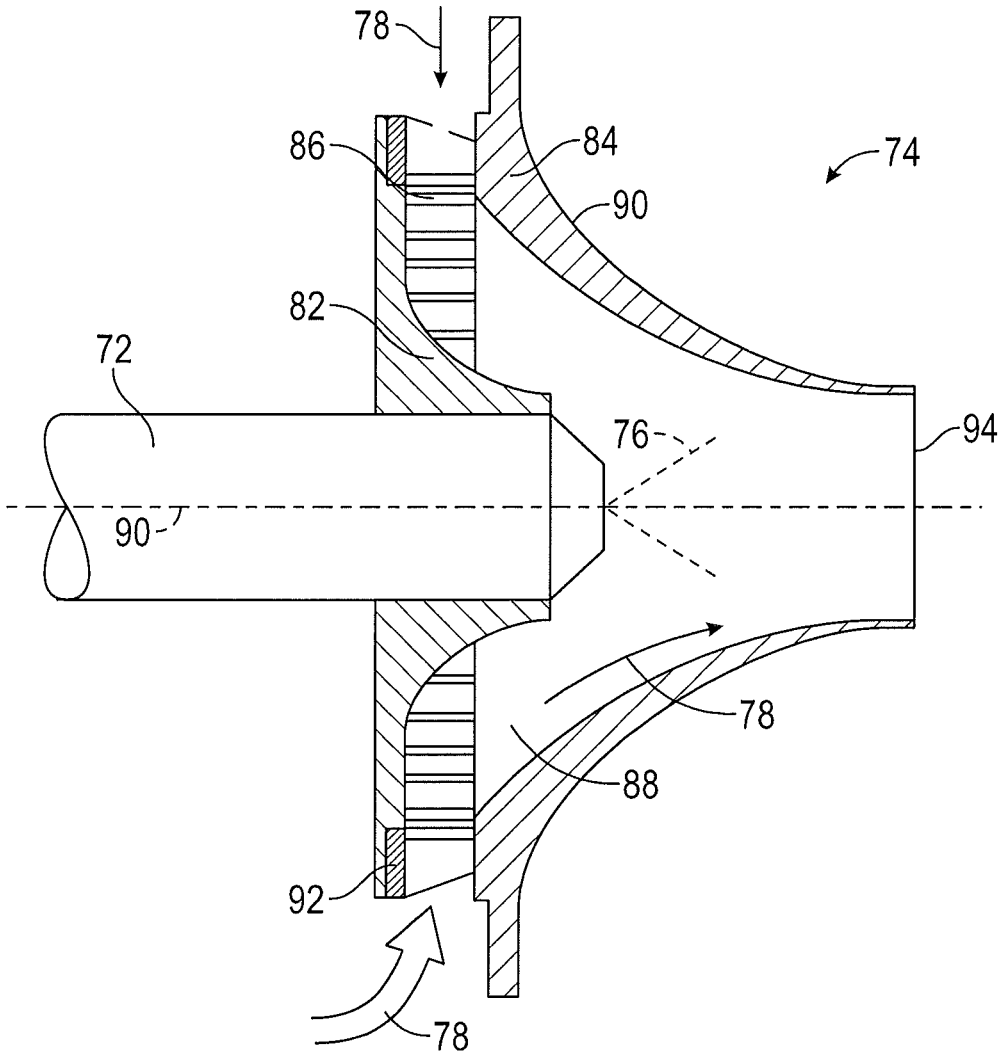
FIG. 3 is a schematic view of an embodiment of a fuel injector of a combustor of a gas turbine engine.

At least one fuel injector 70 extends at least partially through the combustor bulkhead 68. The fuel injector 70 includes a nozzle 72 and a swirler 74 located radially outboard of the nozzle 72. Both the nozzle 72 and the swirler 74 may positioned around an injector axis 90. The nozzle 72 receives a fuel flow 76 in disperses the fuel flow 76 into the combustion chamber 62 to be mixed and combusted with a flow of combustor air 78, which passes through the swirler 74. Referring now to FIG. 3, the swirler 74 includes a swirler housing 80 having an inner shroud 82 positioned around the nozzle 72, and in some embodiments abutting the nozzle 72. An outer shroud 84 is positioned radially outboard of the inner shroud 82. A plurality of swirler vanes 86 extend between the outer shroud 84 and the inner shroud 82 such that the combustor air 78 flows into the combustion chamber 62 via a plurality of swirler passages 88 defined between the outer shroud 84, the inner shroud 82 and the plurality of swirler vanes 86. The combustor air 78 enters the swirler 74 at a swirler entrance 92, and exits the swirler 74 through a swirler exit 94, with the swirler exit 94 defined by the outer shroud 84.

Figure 4:
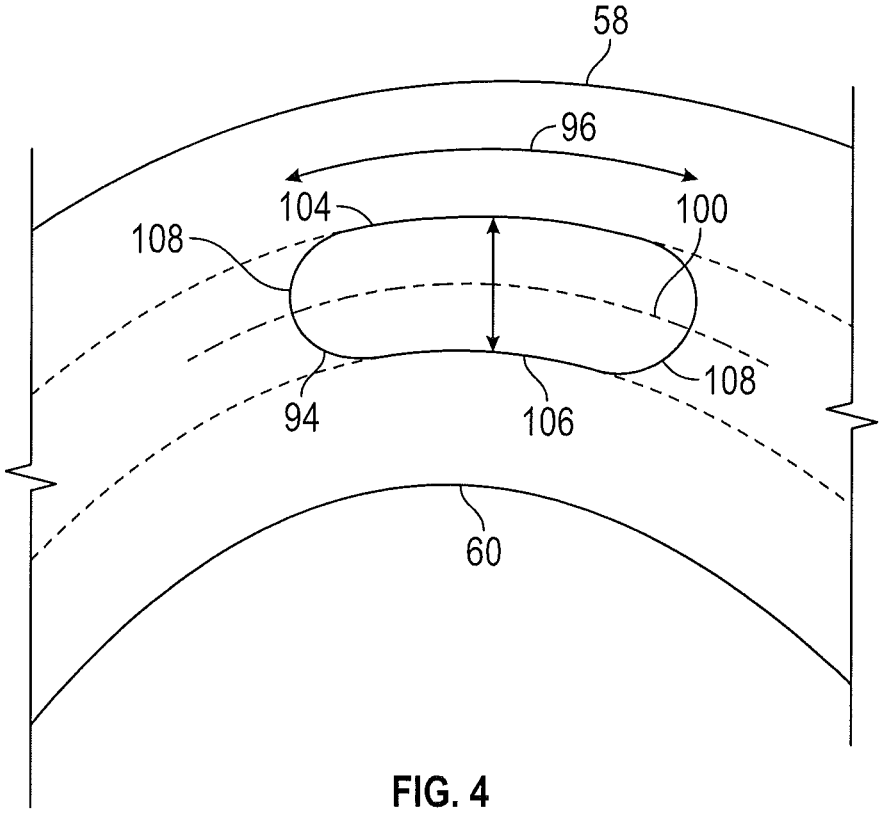
FIG. 4 is a schematic view of an embodiment of a swirler for a combustor of a gas turbine engine

Referring now to FIG. 4, shown is an end view of the swirler 74 illustrating, in particular, the swirler exit 94. The swirler exit 94 is non-circular and is circumferentially elongated, such that a circumferential width 96, defined by a length of a curvilinear circumferential axis 100 of the swirler exit 94, is greater than a radial width 98 of the swirler exit 94, defined by a length of a radial axis of the swirler exit 94. In some embodiments, the circumferential width 96 is between about 1.5 times and 3 times the radial width 98. In some embodiments, the circumferential axis 100 is coaxial with the inner shell 60 and/or the outer shell 58. In some embodiments the swirler exit 84 has an outboard exit portion 104 formed with an outboard radius coaxial with the inner shell 60 and/or the outer shell 58. Further, the swirler exit 84 has an inboard exit portion 106 formed with an inboard radius coaxial with the inner shell 60 and/or the outer shell 58. In some embodiments, the outboard exit portion 104 and/or the inboard exit portion 106 are coaxial with the engine central longitudinal axis A, and/or with the curvilinear circumferential axis 100. The outboard exit portion 104 is connected to the inboard exit portion 106 by circumferential end portions 108, which in some embodiments may be curvilinear as shown in FIG. 4, or alternatively may be linear.

By elongating the swirler exit 94 in the circumferential direction, a circumferentially elongated and radially reduced flame pattern is produced downstream of the swirler 74, as compared to a conical flame pattern produced by a circular swirler exit. Such a circumferentially elongated flame pattern reduces flame touchdown at the outer shell 58 and/or at the inner shell 60, thus reducing combustor panel hot spots and improving durability of the combustor.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A combustor for a gas turbine engine, comprising:
- an annular combustor shell, the annular combustor shell defining a combustion chamber; and
- a fuel injector extending at least partially into the combustion chamber, and configured to deliver a flow of fuel and a flow of combustion air into the combustion chamber for combustion, the fuel injector including a swirler with a swirler exit having a circumferential width along a circumferential axis greater than a radial width along a radial axis, the swirler exit including:
  - an inboard exit portion formed with an inboard radius;
  - an outboard exit portion formed with an outboard radius; and
  - a circumferential end portion connecting the inboard exit portion and the outboard exit portion, the circumferential end portion continuously curvilinear from the inboard exit portion to the outboard exit portion;
  - wherein one or more of the inboard radius and the outboard radius are coaxial with the annular combustor shell.

2. The combustor of claim 1, wherein the circumferential axis is coaxial with the annular combustor shell.

3. The combustor of claim 1, wherein the circumferential width is between 1.5 times the radial width and 3 times the radial width.

4. The combustor of claim 1, wherein the annular combustor shell includes:
- an outer shell;
- an inner shell located radially inboard of the outer shell; and
- a combustor bulkhead extending between the inner shell and the outer shell;
- wherein the fuel injector extends at least partially through the combustor bulkhead into the combustion chamber.

5. The combustor of claim 1, wherein the fuel injector includes a fuel nozzle, with the swirler disposed radially outboard of the fuel nozzle.

6. The combustor of claim 1, wherein the swirler includes a plurality of swirler vanes disposed between a swirler entrance and the swirler exit.

7. A gas turbine engine comprising:
- a turbine section; and
- a combustor section to provide combustion gases to the turbine section to drive the turbine section, the combustion section including:
  - an annular combustor shell, the annular combustor shell defining a combustion chamber; and
  - a fuel injector extending at least partially into the combustion chamber, and configured to deliver a flow of fuel and a flow of combustion air into the combustion chamber for combustion, the fuel injector including a swirler with a swirler exit having a circumferential width along a circumferential axis greater than a radial width along a radial axis, the swirler exit including:
    - an inboard exit portion formed with an inboard radius;

an outboard exit portion formed with an outboard radius; and a circumferential end portion connecting the inboard exit portion and the outboard exit portion, the circumferential end portion continuously curvilinear from the inboard exit portion to the outboard exit portion;

wherein one or more of the inboard radius and the outboard radius are coaxial with the annular combustor shell.

8. The gas turbine engine of claim 7, wherein the circumferential axis is coaxial with the annular combustor shell.

9. The gas turbine engine of claim 7, wherein the circumferential width is between 1.5 times the radial width and 3 times the radial width.

10. The gas turbine engine of claim 7, wherein the annular combustor shell includes:

an outer shell;

an inner shell located radially inboard of the outer shell; and a combustor bulkhead extending between the inner shell and the outer shell;

wherein the fuel injector extends at least partially through the combustor bulkhead into the combustion chamber.

11. The gas turbine engine of claim 7, wherein the fuel injector includes a fuel nozzle, with the swirler disposed radially outboard of the fuel nozzle.

12. The gas turbine engine of claim 7, wherein the swirler includes a plurality of swirler vanes disposed between a swirler entrance and the swirler exit.

13. A swirler for a gas turbine engine, comprising:

a swirler entrance; and a swirler exit, the swirler exit having a circumferential width along a curvilinear circumferential axis greater than a radial width along a radial axis, the swirler exit including:

an inboard exit portion formed with an inboard radius;

an outboard exit portion formed with an outboard radius; and a circumferential end portion connecting the inboard exit portion and the outboard exit portion, the circumferential end portion continuously curvilinear from the inboard exit portion to the outboard exit portion;

wherein one or more of the inboard radius and the outboard radius are coaxial with the curvilinear circumferential axis.

14. The swirler of claim 13, wherein the circumferential width is between 1.5 times the radial width and 3 times the radial width.

15. The swirler of claim 13, further comprising a plurality of swirler vanes disposed between the swirler entrance and the swirler exit.

* * * * *